United States Patent [19]

Namba et al.

[11] Patent Number: 4,527,699

[45] Date of Patent: Jul. 9, 1985

[54] VESSEL FOR STORING LIQUID

[75] Inventors: Kazuya Namba, Funabashi; Kazuya Yano, Yokohama; Hirosi Nakazima, Narita; Yu Muraki, Tokyo, all of Japan

[73] Assignee: Nippon Light Metal Co., Ltd., Tokyo, Japan

[21] Appl. No.: 543,299

[22] Filed: Oct. 19, 1983

[30] Foreign Application Priority Data

Oct. 22, 1982 [JP] Japan ..... 57-159752[U]

[51] Int. Cl.[3] ..... B65D 23/02

[52] U.S. Cl. ..... 215/1 C; 215/1 R; 220/67; 229/5.7

[58] Field of Search ..... 215/1 C, 1 R, 10; 229/48 SC, 48 T, 5.6, 5.7; 220/67, DIG. 29, DIG. 31

[56] References Cited

U.S. PATENT DOCUMENTS

| | | | |
|---|---|---|---|
| 2,324,387 | 7/1943 | Haycock | 229/5.6 |
| 3,434,644 | 3/1969 | Collie | 215/1 C |
| 3,602,257 | 2/1970 | Berleyoung | 220/DIG. 31 |
| 3,940,001 | 2/1976 | Haefner et al. | 215/1 C |
| 3,981,412 | 9/1976 | Asmus | 215/1 C |
| 4,301,939 | 11/1981 | Pupp | 229/5.6 |
| 4,337,104 | 6/1982 | Lynn | 215/1 C |
| 4,356,926 | 11/1982 | Priestly et al. | 215/1 C |

FOREIGN PATENT DOCUMENTS

| | | | |
|---|---|---|---|
| 2005842 | 4/1969 | France | 215/1 C |
| 2109333 | 6/1983 | United Kingdom | 215/1 C |

*Primary Examiner*—George E. Lowrance
*Assistant Examiner*—David T. Fidei
*Attorney, Agent, or Firm*—Oblon, Fisher, Spivak, McClelland & Maier

[57] ABSTRACT

The vessel for sealingly storing liquid therein comprises a cylindrical trunk member of rectangular cross-section having at least an open end and made of a laminated sheet material having a thermally bonding synthetic resin layer on the inner surface thereof and at least one end member having an axially extending flange portion having a thermally bonding synthetic resin layer on the outer surface thereof, the flange portion of the end member being adapted to be fitted in the open end of the trunk member so as to be thermally bonded thereto for forming hermetical sealing therebetween. An outwardly projecting thin axial ear portion is formed at the respective corner of the flange portion of the end member by the thermally bonding synthetic resin layer provided on the outer surface of the flange portion. Each of the ear portions is adapted to be deformed and effectively fill the clearance which might be formed between the respective corner of the open end of the trunk member and the respective corner of the flange portion when the latter is fitted in the former and thermally bonded thereto so that hermetical sealing is insured therebetween.

5 Claims, 11 Drawing Figures

VESSEL FOR STORING LIQUID

BACKGROUND OF THE INVENTION

The present invention relates to a vessel for sealingly storing therein liquid such as juices, liquors and the like, and more particularly, to a vessel simple in construction and mainly made of a laminated sheet material having at least a thermally bonding synthetic resin layer.

A vessel of the type described above is generally formed in the rectangular form so as to improve the transportability and efficiency of stock space by bending the sheet at right angle and thermally bonding the overlapping portions thereof so as to form the seam for constructing the vessel. Such a seam must possess a high hermetical sealing property with a high reliability while a high efficiency of production is required in order to protect the contents and lower the production cost. Further, in case the content of the vessel is to be successively consumed repeatedly, the hermetical sealing of the vessel must be insured repeatedly.

A vessel of the type described above was disclosed in Japanese Utility Model Public Disclosure No. 57-55718 (1982). The vessel disclosed therein comprises a cylindrical trunk member of rectangular cross section having two opposite open ends made of a laminated sheet material having on the inner surface thereof a thermally bonding synthetic resin layer and formed by outwardly bending the opposing side edge of the sheet material so as to be thermally bonded to each other for forming the cylindrical form of the trunk member, and two end members each having an axially extending flange portion adapted to be fitted in the respective open end of the trunk member, the flange portion of each end member being provided on the outer surface thereof with a thermally bonding synthetic resin layer so as to be thermally bonded to the respective open end of the trunk member when the former is fitted in the latter and heated for effecting the thermal bonding therebetween. Since a clearance is necessarily formed between the seam of the trunk member and the opposing corner of the end member, an outwardly projecting thin ear portion is formed at the opposing corner of the end member by the medium of the thermally bonding synthetic resin layer provided on the outer surface thereof in order to seal the clearance. The ear portion is deformed and fills the clearance for achieving the hermetical sealing when the flange portion is fitted in the open end with the ear portion positioned in opposing relation to the seam of the trunk member and heated for effecting the thermal bonding therebetween.

With such a construction of the vessel described above, however, the orientation of the end member with respect to the orientation of the seam of the trunk member is strictly required in the automatic assembling line in the production of such vessels thereby considerably deteriorating the efficiency of the production of the vessels.

On the other hand, the present inventors have found out that a clearance tends to occur between the corner of the flange portion of the end member and the opposing corner of the open end of the trunk member even though no seam is formed there and such a clearance must also be sealed positively.

SUMMARY OF THE INVENTION

The present invention aims at avoiding the above described disadvantages of the prior art vessel.

It is therefore the object of the present invention to provide a vessel formed by the laminated sheet material as described above, which insures the positive hermetical sealing of the vessel while the productivity in the automatic assembling line is considerably improved.

The above object is achieved in accordance with the present invention by providing a vessel for sealingly storing liquid therein consisting of a trunk member of rectangular cross-section having at least an open end and made of a laminated sheet material having a thermally bonding synthetic resin layer at least on the inner surface thereof, and at least an end member having an axially extending flange portion provided with a thermally bonding synthetic resin layer on the outer surface thereof, the flange portion being adapted to be fitted in the open end of the trunk member so as to be thermally bonded thereto for forming hermetical sealing therebetween, the vessel being characterized by hermetical sealing means formed between the respective corner of said open end of the trunk member and the respective corner of the flange portion of the end member, thereby permitting the clearance which might be formed between the respective corner of the open end and the respective corner of the flange portion to be positively closed so as to insure hermetical sealing therebetween.

In the present invention, it is preferred to form the sealing means by an outwardly projecting thin axial ear portion formed by the thermally bonding synthetic resin layer provided on the outer surface of the flange portion of the end member and positioned at the respective corner thereof. Each of the ear portions is adapted to be deformed and sealingly fill the clearance between the respective corner of the open end of the trunk member and the respective corner of the flange portion of the end member when the flange portion is filled in the open end and thermally bonded thereto.

With the above construction, the necessity of determining the orientation of the end member with respect to the orientation of the trunk member is obviated thereby considerably improving the productivity in automatic assembling line.

Further, in the present invention, at least a laterally extending elongated ridge is formed on the outer surface of the flange portion of the end member extending circumferentially around the flange portion so as to insure hermetical sealing between the open end of the trunk member and the flange portion when the latter is fitted in the former and thermally bonded thereto.

The trunk member may be provided with an upper and a lower open end to which an upper and a lower end member are thermally bonded respectively.

In case the contents of the vessel are to be successively consumed repeatedly while hermetical sealing must be insured repeatedly, the upper end member is provided with a pouring mouth piece on which a sealing cap is detachably mounted.

DETAILED DESCRIPTION OF THE PREFERRED EMBODIMENTS

Figure 1:
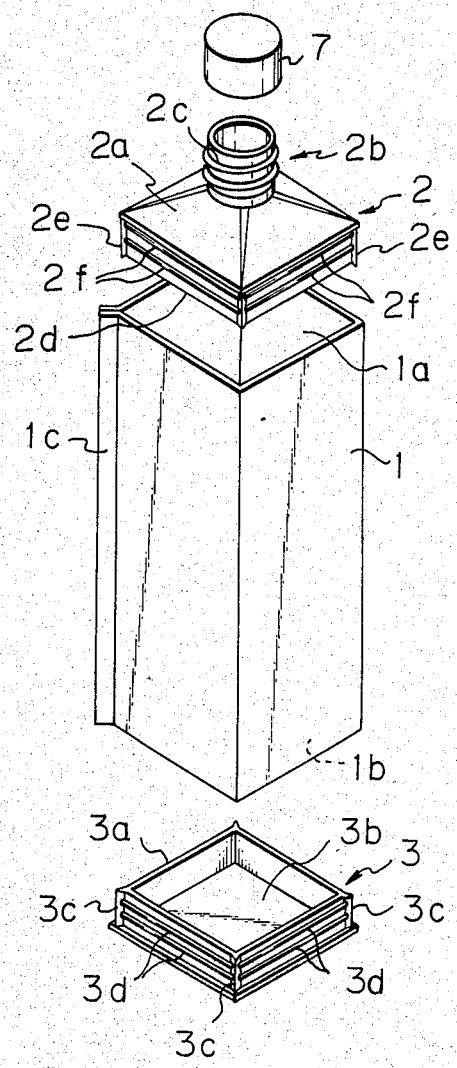
FIG. 1 is an exploded perspective view showing the construction of the embodiment of the vessel of the present invention.

With reference to FIG. 1, the vessel for storing liquid therein constructed in accordance with the present invention consists of a hollow trunk member 1 of rectangular cross-section having an upper open end 1*a* and a lower open end 1*b*, an upper end member 2 adapted to be sealingly joined with the upper open end 1*a*, and a lower end member 3 adapted to be sealingly joined with the lower open end 1*b*.

Figure 2:
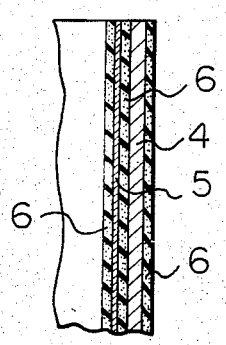
FIG. 2 is a fragmentary cross-sectional view showing the construction of the laminated sheet material for forming the trunk member of the vessel of FIG. 1.

The trunk member 1 is made of a laminated sheet material as shown in FIG. 2 consisting of a paper layer 4 as a main member giving the vessel a light weight, a thin metallic layer 5 such as an aluminum layer as a reinforcing layer serving also as an oxidation preventing material for the liquid contained in the vessel, the layer 5 being bonded to the paper layer 4 by the medium of a non-toxic thermally bonding synthetic resin layer 6, and a non-toxic thermally bonding synthetic resin layer 6 attached to the outer surface each of the paper layer 4 and the metallic layer 5. The thermally bonding synthetic resin layer 6 serves as a corrosion preventing material and also as a bonding agent and may be made of any non-toxic resin material such as polyethylene, polypropylene, polyester and the like, which will not adversely affect the quality of the liquid contained in the vessel.

In order to form the rectangular form of the trunk member 1, the laminated sheet material is at right angle along three parallel lines and the opposing side edges 1*c* are outwardly bent and thermally bonded to each other so as to form a seam by the medium of the inner thermally bonding synthetic layer 6 as shown.

The end members 2 and 3 are thermally bonded to the respective open ends 1*a*, 1*b* of the trunk member 1 at the same time as the opposing side edges 1*c* thereof are thermally bonded to each other to form a seam for forming the trunk member 1.

The upper end member 2 and the lower end member 3 are preferably made entirely of a non-toxic thermally synthetic resin such as polyethylene, polypropylene, polyester and the like. However, they may be made by a thin metallic layer such as an aluminum layer on the surfaces of which the thermally bonding synthetic resin layers are attached.

Figure 3:
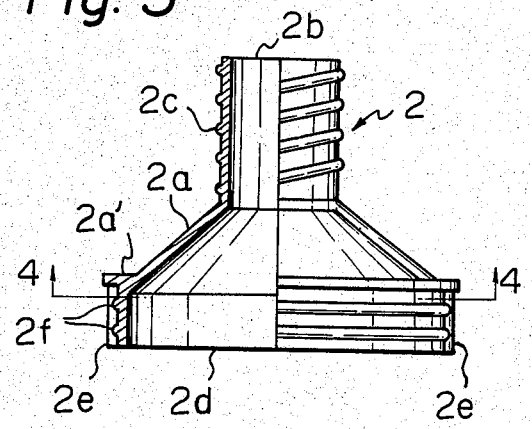
FIG. 3 is a side view with the left hand half shown in cross-section showing the construction of the upper end member of the vessel of FIG. 1.

The end plate 2*a* of the upper end member 2 may be provided with a pouring mouth piece 2*b* (FIG. 3) formed with a pouring screw thread 2*c* on the outer surface thereof on which a sealing cap is threadedly and detacheably mounted so that a portion of liquid in the vessel can be successively and repeatedly taken out and then the vessel can be hermetically sealed again by means of the cap 7.

An axially extending flange portion 2*d* is provided around the periphery of the end plate 2*a* extending downwardly from the positioning ridge 2*a'* as shown in FIG. 1. The flange portion 2*d* is adapted to snugly fit in the upper open end 1*a* of the trunk member 1 with the positioning ridge 2*a'* contacting the edge of the open end 1*a* so as to be thermally bonded sealingly thereto.

In the lower end member, an axially extending flange portion 3*a* is provided around the periphery of the end plate 3*b* of the lower end member 3 extending upwardly. The flange portion 3*a* is adapted to snugly fit in the lower open end of the trunk member 1 so as to be thermally bonded sealingly thereto.

Since a certain clearance is necessarily formed between the flange portion 2*d* of the upper end member 2 and the upper open end 1*a* of the trunk member 1 at the respective corners thereof, particularly, at the corner of the trunk member 1 where the seam is formed by the thermally bonded side edges 1*c*, hermetically sealing means must be provided at the respective corners in order to ensure hermetical sealing of the vessel.

Figure 4:
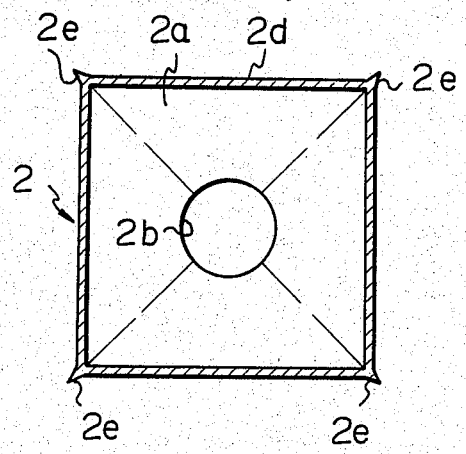
FIG. 4 is a cross-sectional view taken along line 4—4 in FIG. 3.

In accordance with the characteristic feature of the present invention, an outwardly projecting thin axial ear portion 2*e* made of the thermally bonding synthetic resin material forming the upper end member 2 is formed at the respective corner of the flange portion 2*d* as shown in FIG. 4 in order to form a positive sealing means at the corners.

Thus, when the upper end member 2 is thermally bonded to the upper open end 1*a* of the trunk member 1, the ear portions 2*e* are deformed by the heat and positively fill the clearances between the corners of the open end 1*a* and the flange portion 2*d* and hermetically seal the clearances.

In accordance with another characteristic feature of the present invention, at least a laterally extending elongated ridge 2*f* (two ridges shown in the figures) is provided on the outer surface of the flange portion 2*d* extending circumferentially therearound. The ridge 2*f* serves to insure the hermetical sealing between the inner surface of the open end 1*a* and the outer surface of the flange portion 2*d* when the thermal bonding is effected.

In a similar manner, the lower end member 3 is provided with an outwardly projecting thin axial ear portion 3*c* at each corner of the flange portion 3*a* as well as at least one laterally extending elongated ridge 3*d* extending circumferentially around the flange portion 3*a*, the function thereof being the same as the ear portion 2*e* and the ridge 2*f* described above.

With the above described construction of the vessel, errors in dimension of the trunk member and the end member can be absorbed, while positive sealing of the vessel is insured.

Further, the necessity for determining the orientation of the end members with respect to the orientation of the trunk portion for effecting the thermal bonding thereof is dispensed with thereby greatly improving the efficiency of the production line of the vessels.

Figure 5:
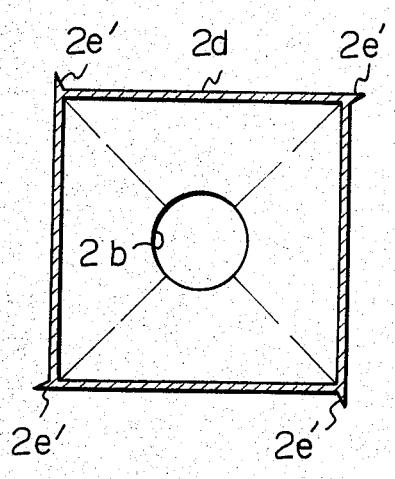
FIG. 5 is a cross-sectional view similar to FIG. 4 but showing another form of the outwardly extending thin ear portion formed at each corner of the end member of FIG. 3.

FIG. 5 shows an alternative form of the ear portion 2*e'*, the function thereof being the same as the ear portion 2*e*.

Figure 6:
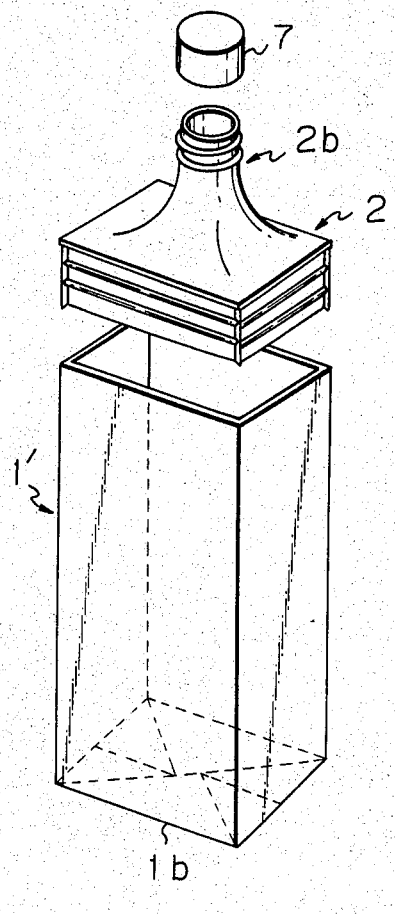
FIG. 6 is an exploded perspective view showing another embodiment of the vessel of the present invention.

FIG. 6 shows an alternative form of the trunk member 1' which has a closed lower end 1*b'*. In this case, the lower end member is dispensed with. The function of the upper end member 2 is the same as that previously described.

Figure 7:
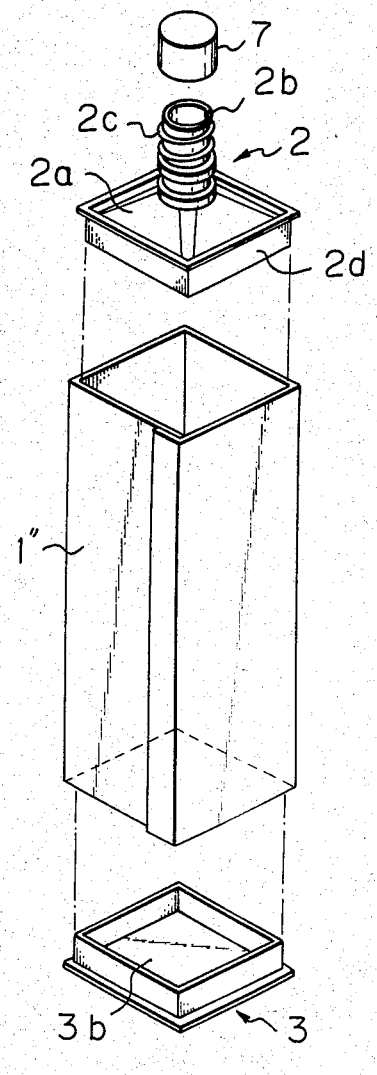
FIG. 7 is an exploded perspective view showing a further possible configuration of the vessel to which the present invention is applicable.
Figure 9:
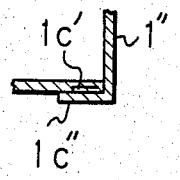
FIG. 9 is a fragmentary cross-sectional view showing the construction of the seam formed in the trunk member of the vessel of FIG. 7.

FIG. 7 shows a possible form of the vessel to which the present invention is applicable. In this case, the seam of the trunk member 1'' is formed by bending one of the opposing side edge 1*c'* back upon itself by thinning the bent portion (so as to expose the inner resin layer 6) and bending the other side edge 1*c''* onto the bent back portion 1*c'* and effecting thermal bonding therebetween as shown in FIG. 9. Since only the thermal bonding synthetic resin layer 6 is exposed to the liquid in this case, there is no danger of the liquid oozing out of the vessel.

Figure 8:
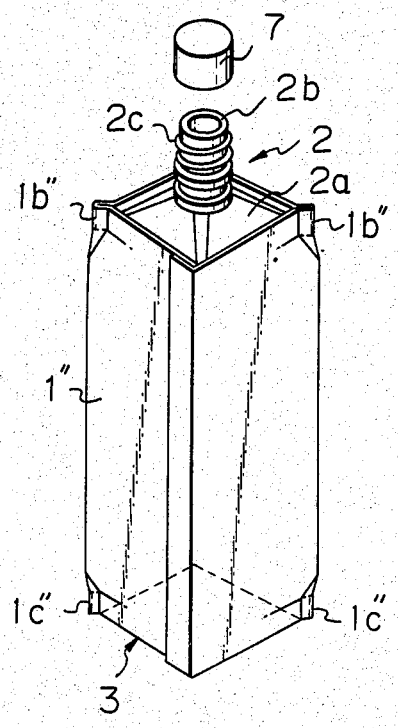
FIG. 8 is a perspective view with a cap shown removed from the pouring mouth piece showing the complete construction of the vessel shown in FIG. 7.

In effecting the thermal bonding, at least the opposite two corners 1*b''*, 1*b''* at the upper end of the trunk member 1'' except the corner where the seam is formed and at least the opposite two corners 1*c''*, 1*c''* at the lower end of the trunk member 1'' except the corner where the seam is formed are pinched firmly as shown in FIG. 8 so that all the clearance which might occur between the open ends of the trunk member 1'' and the end members 2, 3 are positively absorbed thereby assuring the hermetical sealing of the vessel.

Figure 10:
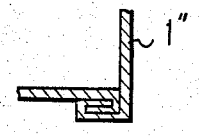
FIG. 10 is a fragmentary cross-sectional view similar to FIG. 9 but showing another construction of the seam.

FIG. 10 shows another form of the seam of the trunk member. In this case the opposing side edge are thinned and joined with each other by bending the same back upon themselves to form a curled seam. The function is the same as that described in connection with FIG. 9.

Figure 11:
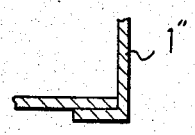
FIG. 11 is a fragmentary cross-sectional view similar to FIG. 9 but showing a further construction of the seam.

FIG. 11 shows a further form of the seam of the trunk member when the same is made of a thermally bonding synthetic resin sheet material having no oozing nature. In this case, it suffices to merely bend one of the opposing side edges onto the other side edge and effect thermal bonding therebetween. Since the sheet material of the trunk member is of non-oozing nature, there is no danger of oozing the liquid and of the vessel.

What is claimed is:

1. A vessel for sealingly storing liquid therein, said vessel comprising:

a trunk member of rectangular cross-section having at least one open end made of a laminated sheet material having a thermally bonding synthetic resin layer at least on the inner surface thereof, at least one end member having an axially extending flange portion provided with a thermally bonding synthetic resin layer on the outer surface thereof, said flange portion being adapted to be fitted in said open end of said trunk member so as to be thermally bonded thereto for forming hermetical sealing therebetween, and hermetical sealing means formed between each respective corner of said open end of said trunk member and a respective corner of said flange portion of said end member, said sealing means comprising an outwardly projecting thin axial ear portion formed by said thermally bonding synthetic resin layer provided on the outer surface of said flange portion of said end member and positioned at the respective corner thereof, each of said ear portions being adapted to be deformed and sealingly fill a clearance between the respective corner of said open end of said trunk member and the respective corner of said flange portion of said end member when said flange portion is fitted in said open end and thermally bonded thereto, thereby permitting said clearance to be positively closed so as to insure hermetical sealing therebetween.

2. A vessel as set forth in claim 1, wherein at least a laterally extending elongated ridge is formed on the outer surface of said flange portion of said end member extending circumferentially around said flange portion so as to insure hermetical sealing between said open end of said trunk member and said flange portion when the latter is fitted in the former and thermally bonded thereto.

3. A vessel as set forth in claim 1, wherein said trunk member is provided with an upper and a lower open end to which an upper and a lower end member are thermally bonded, respectively.

4. A vessel as set forth in claim 3, wherein said upper end member is provided with a pouring mouth piece on which a sealing cap is detacheably mounted.

5. A vessel for sealingly storing liquid therein, said vessel comprising:

a trunk member of rectangular cross-section having at least one open end made of a laminated sheet material having a thermally bonding synthetic resin layer at least on the inner surface thereof, at least one end member having an axially extending flange portion provided with a thermally bonding synthetic resin layer on the outer surface thereof, said flange portion being adapted to be fitted in said open end of said trunk member so as to be thermally bonded thereto for forming hermetical sealing therebetween, and hermetical sealing means formed between each respective corner of said open end of said trunk member and a respective corner of said flange portion of said end member, said sealing means comprising at least two opposing pinched corners of said open end of said trunk member, said pinched corners being sufficiently pinched that thermally bonding synthetic resin layers of said trunk member and said end member contact and bond with one another at clearances of said corners, thereby permitting said clearances to be positively closed so as to insure hermetical sealing.

* * * * *